US005421651A

United States Patent [19]

Pickering et al.

[11] Patent Number: 5,421,651

[45] Date of Patent: Jun. 6, 1995

[54] MIXING KETTLE

[76] Inventors: Michael D. Pickering, 102 Covington Dr., Barrington, Ill. 60010; Lawrence G. Kubacki, 2700 Hobson Rd., Downers Grove, Ill. 60515

[21] Appl. No.: 241,026

[22] Filed: May 11, 1994

[51] Int. Cl.[6] ..... B01F 7/04

[52] U.S. Cl. ..... 366/311; 99/348; 366/313

[58] Field of Search ..... 366/279, 273, 274, 309, 366/311, 312, 313, 52, 67

[56] References Cited

U.S. PATENT DOCUMENTS

| | | | |
|---|---|---|---|
| 3,752,057 | 8/1973 | Groen | 99/348 |
| 4,571,091 | 2/1986 | Pardo | 366/311 |
| 4,790,667 | 12/1988 | Pardo | 99/348 |
| 4,818,116 | 4/1989 | Pardo | 99/348 |
| 5,009,510 | 4/1991 | Gabriele | 366/311 |

OTHER PUBLICATIONS

Kettles and Processing Equipment Sales Brochure for Process Systems, Inc. (No Date).

*Primary Examiner*—Robert W. Jenkins

*Attorney, Agent, or Firm*—Henderson & Sturm

[57] ABSTRACT

The present invention discloses a mixing kettle which utilizes magnetic force to maintain contact between the scraper blades and the interior surface of the kettle. A series of scraper blades are pivotally mounted within pivot brackets carried on horizontal, anchor type scrape-surface agitators. A first magnet is imbedded within each scraper blade, fabricated from nylon or other similar material, while a second magnet of like polarity is carried within the pivot bracket adjacent the first magnet. The repulsive force between the magnets forces the blade to pivot such that the scraper end of the blade is forced against and rides along the interior of the kettle.

7 Claims, 3 Drawing Sheets

MIXING KETTLE

TECHNICAL FIELD

This invention relates to mixing kettles, and more particularly to mixing kettles which utilize rotating agitators with scraper blades.

BACKGROUND ART

Mixing kettles are well known in the art and are utilized in the food, pharmaceutical, confectionary, and chemical industries for mixing various substances. These Kettles are typically hemispherical in shape and utilize one or more agitator arms, carrying various types of blades, which rotate within the kettle either about a vertical or a horizontal axis. One set of blades is ordinarily designed to scrape along the interior surface of the kettle to further enhance the mixing process and to prevent the product from burning on heated kettles. These scraper blades pivot on the agitator arms and are biased against the kettle interior surface by means of one or more springs. However, the use of such biasing springs has been found to be unsatisfactory because they occasionally break and become lost within the substance being mixed. This is of course completely unacceptable, particularly for food products.

DISCLOSURE OF THE INVENTION

The present invention discloses a mixing kettle which utilizes magnetic force instead of springs to maintain contact between the scraper blades and the interior surface of the kettle. A series of scraper blades is pivotally mounted within pivot brackets carried on horizontal, anchor type scrape-surface agitator arms. A first magnet is imbedded within each scraper blade, fabricated from nylon or other similar material, while a second magnet of like polarity is carried within the pivot bracket adjacent the first magnet. The repulsive force between the magnets forces the blade to pivot such that the scraper end of the blade is biased against and rides along the interior of the kettle.

BRIEF DESCRIPTION OF THE DRAWINGS

These and other attributes of the invention will become more clear upon a thorough study of the following description of the best mode for carrying out the invention, particularly when reviewed in conjunction with the drawings, wherein.

BEST MODE FOR CARRYING OUT THE INVENTION

Figure 1:
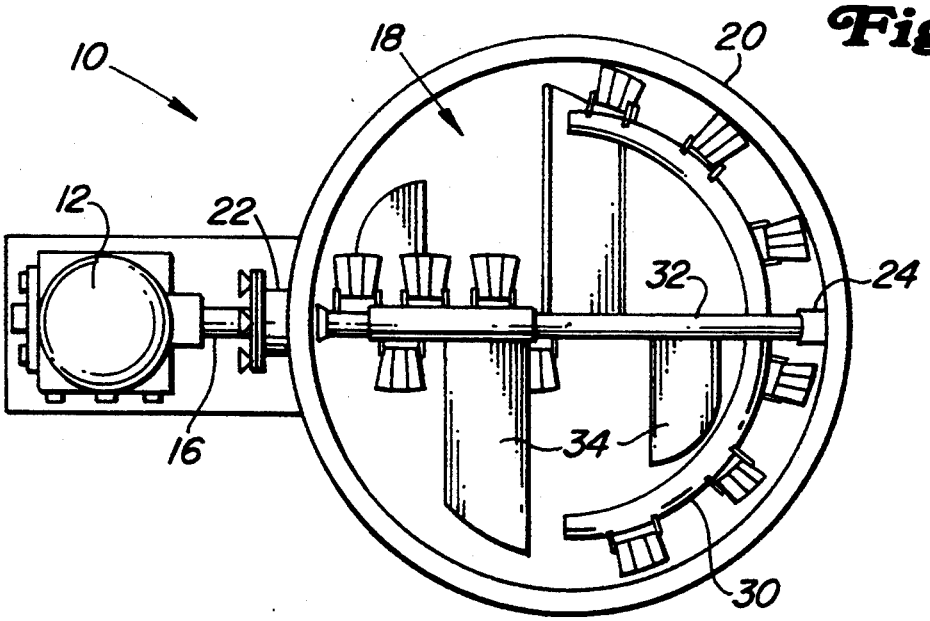
FIG. 1 is a fop plan view of a mixing kettle utilizing horizontal, anchor type agitators.
Figure 2:
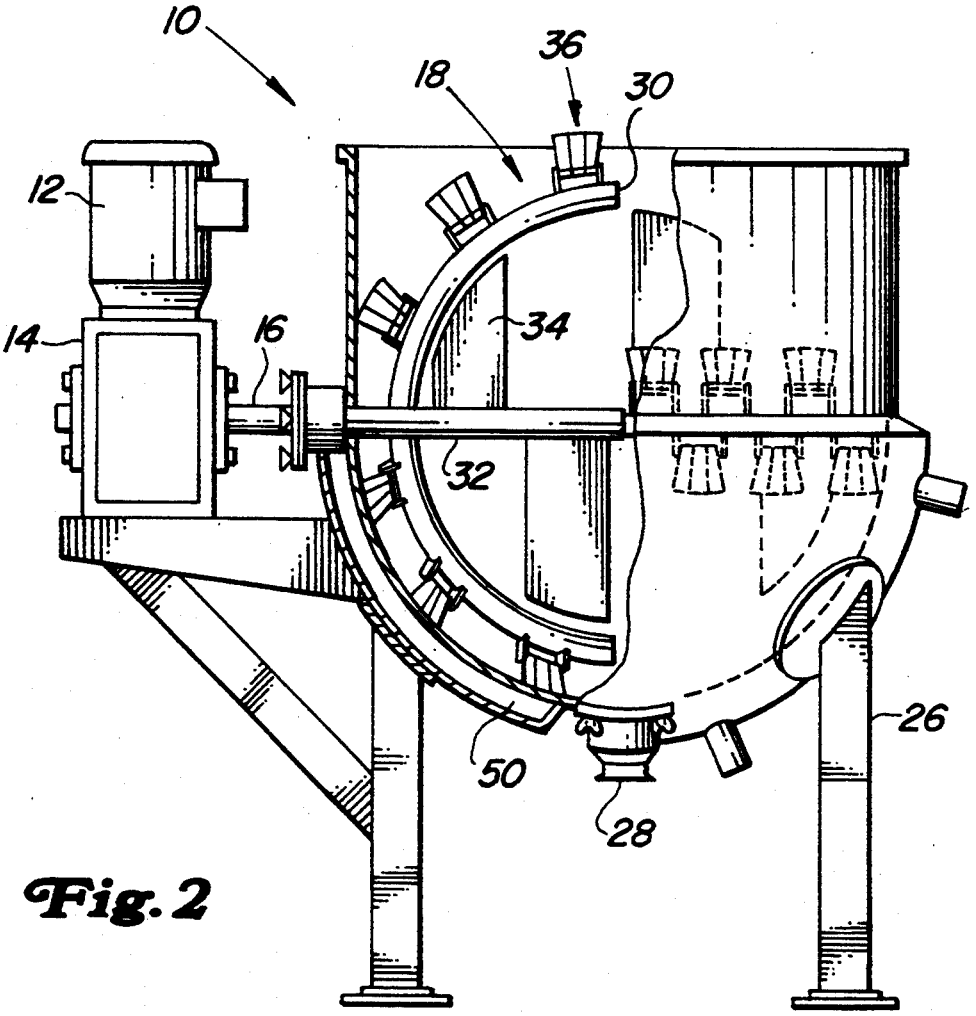
FIG. 2 is a side elevational view in partial section of the kettle in FIG. 1.

Referring now to FIGS. 1 and 2, a mixing kettle of the present invention is depicted generally as 10, and comprises a drive motor 12 acting through a gearbox 14 to power a drive shaft 16, which in turn rotates an agitator 18 about a horizontal axis passing through a hemispherical kettle 20. The agitator 18 is carried in a pair of bearings 22, 24 secured within opposing sides of the kettle 20. Such mixing kettles are generally elevated above the floor by means of legs 26 and are equipped with a center bottom outlet 28 for the removal of the product when mixing is complete. The particular kettle depicted has a steam jacket 50 for heating the product substance during mixing.

Figure 3:
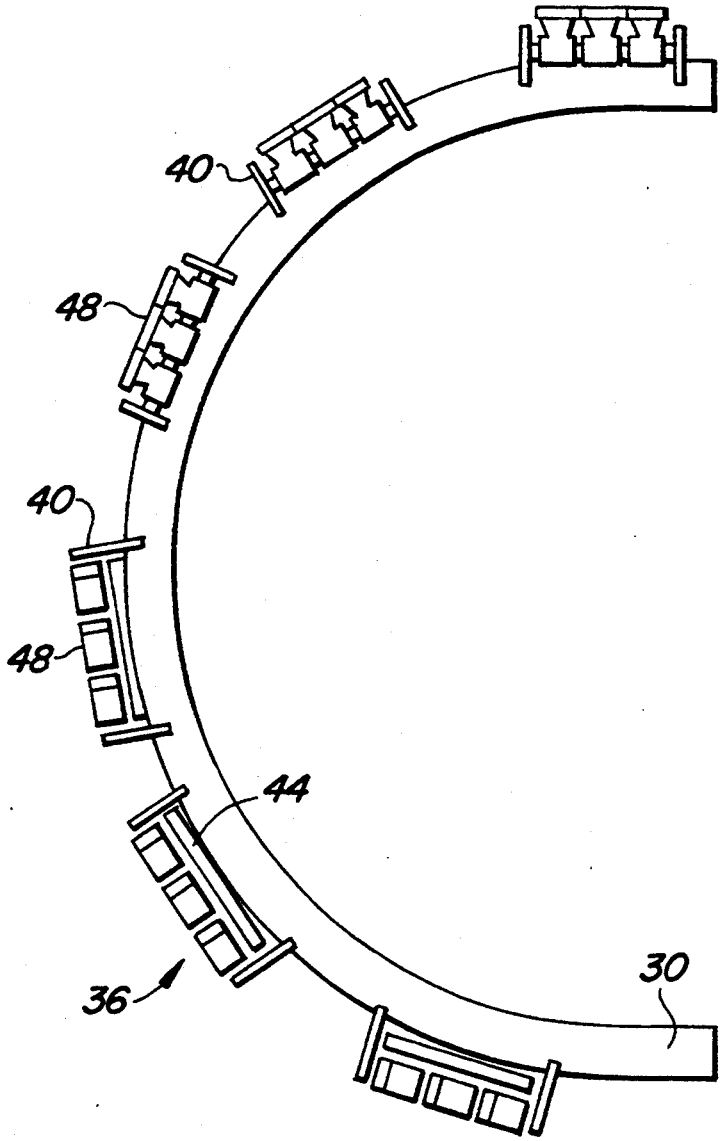
FIG. 3 is a view of on agitator, with the mixing blades removed.
Figure 4:
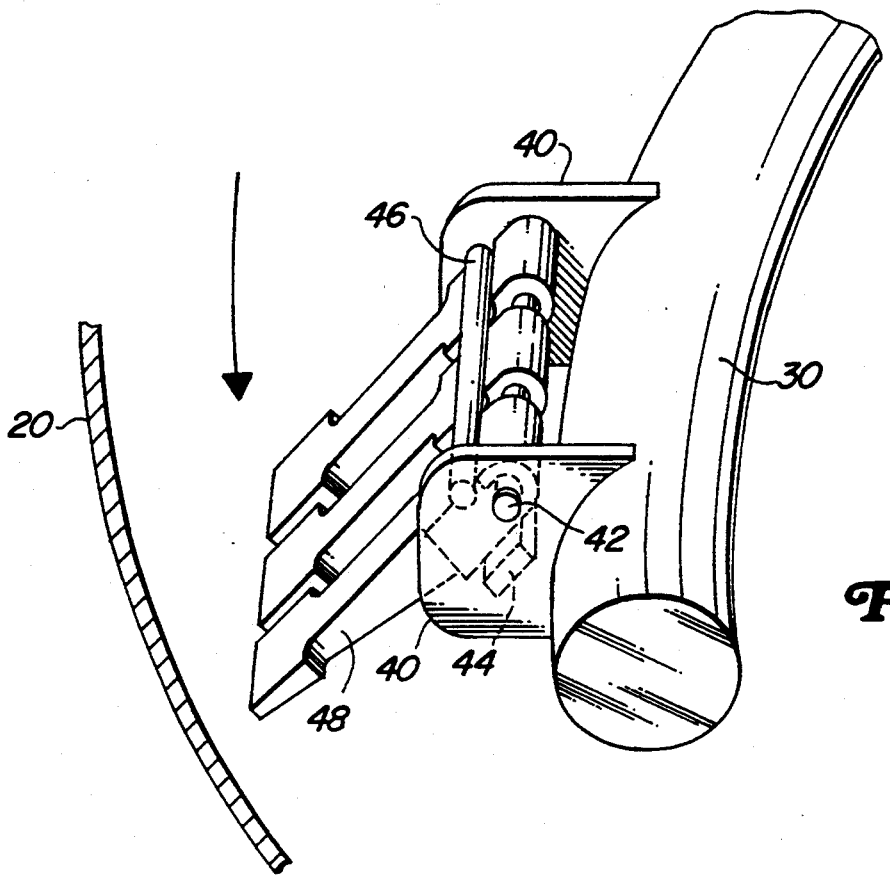
FIG. 4 is a perspective view of the scraper unit having three blades.
Figure 6:
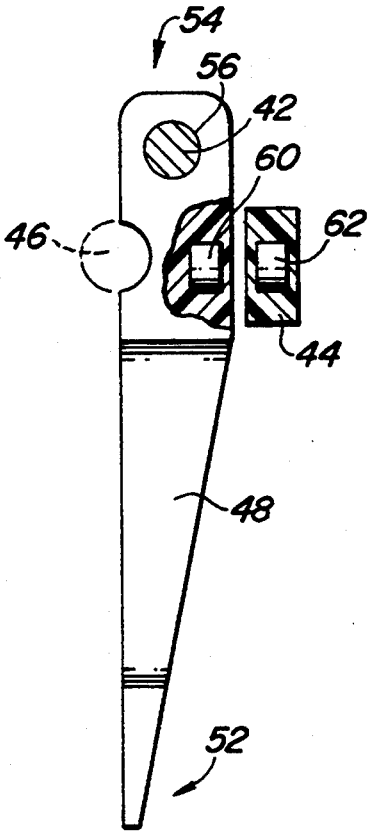
FIG. 6 is a side view of a scraper blade and magnet sleeve, partially in section.

The agitator 18, fabricated from stainless steel, is comprised of a pair of semicircular agitator arms 30 welded to a shaft 32, with the agitator arms 30 offset from each other by 90 degrees on the shaft 32 axis. This type of agitator arm 30 is commonly referred to as an anchor agitator (due to its resemblance to ship's anchor), with this particular assembly referred to as a horizontal, double anchor agitator. The agitator shaft 32 further carries four large stainless steel mixing paddles 34 welded thereto to further enhance the mixing action. The mixing paddles 34 are offset from the agitator arms 30 by approximately 45 degrees about the shaft 32 axis. Referring to FIGS. 3 and 4, it may be seen that each of the agitator arms 30 carries six scraper units 36 which scrape along the interior hemispherical surface of the kettle 20 as the agitator 18 is rotated about the shaft 32 axis. The scraper units 36 are comprised of a bracket 40, a pivot rod 42, a magnet sleeve 44, a limit bar 46, and three scraper blades 48. The scraper blades 48, preferably fabricated from nylon or like material, have a scraper end 52 and a pivot end 54, the pivot end 54 having a pivot hole 56 formed therein. The scraper blades 48 also have a strong, permanent magnet 60 imbedded within the blade 48 adjacent the pivot hole 56 as seen in FIG. 6. The brackets 40 are welded to the outer periphery of the agitator arms 30 and carry the pivot rod 42 welded therein, upon which the scraper blades 48 are pivotally mounted. The brackets 40 also carry a magnet sleeve 44 welded therein adjacent the pivot rod 42, the magnet sleeve 44 itself housing three magnets 62 (FIG. 6) of like polarity as the magnets imbedded within the blades 48. Within the assembled scraper unit 36, there is therefore a strong repulsive force developed between each blade magnet 60 and its counterpart sleeve magnet 62, with this force tending to pivot the scraper blades 48 outward and against the interior surface of the kettle 20. The extent of this pivot motion is limited by means of limit bar 46 which is also welded within the bracket 40 adjacent the pivot rod 42, but opposite the magnet sleeve 44.

Figure 5:
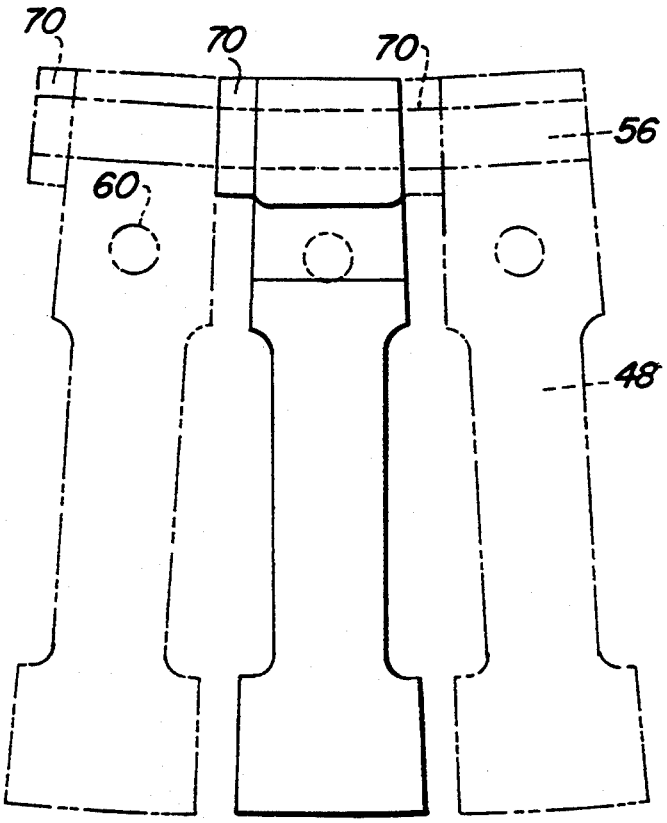
FIG. 5 is a plan view of three scraper blades forming a scraper unit.

As seen in FIG. 5, the scraper blades 48 are originally fabricated with a shoulder 70 and with the scraper end 52 having a curvature corresponding to that of the largest size kettle for which the blades 48 will be used. For smaller kettles, the shoulder 70 is correspondingly shaved off somewhat, thereby reducing the spacing between the blades and effectively increasing the curvature of the scraper end of the complete unit.

Obviously, many modifications and variations of the present invention are possible in light of the above teachings. It is therefore to be understood that, within the scope of the appended claims, the invention may be practiced otherwise than as specifically described.

What is claimed is:

1. A mixing kettle, comprising:

(a) a hemispherical kettle having an interior surface and an exterior surface;

(b) an agitator arm rotatably mounted within said kettle;

(c) a plurality of scraper blades pivotally affixed to said agitator arm; and (d) magnetic means for forcing said scraper blades against said interior surface of said kettle.

2. The mixing kettle as recited in claim 1 wherein said agitator arm is a horizontal, double anchor type agitator arm.

3. The mixing kettle as recited in claim 2 further comprising a plurality of pivot brackets affixed to said agitator arm.

4. The mixing kettle as recited in claim 3 wherein said magnetic forcing means comprises a first magnet imbedded within said scraper blade and a second magnet secured within said pivot bracket.

5. The mixing kettle as recited in claim 4 wherein said pivot bracket includes a pivot rod extending therein upon which said scraper blade is pivotally mounted.

6. The mixing kettle as recited in claim 5 wherein said pivot bracket further includes an elongate, magnet sleeve extending within said bracket, in spaced apart relation to said pivot rod and housing a plurality of said second magnets.

7. The mixing kettle as recited in claim 6, further comprising a blade limit bar extending within said bracket, in spaced apart relation to said pivot rod, whereby the pivot of said scraper blades may be limited.

* * * * *